US005952107A

United States Patent [19]

Roth et al.

[11] Patent Number: 5,952,107

[45] Date of Patent: Sep. 14, 1999

[54] BACKCOAT FOR THERMAL TRANSFER RIBBONS

[75] Inventors: Joseph D. Roth, Springboro; Christopher C. Vosler, Piqua; Thomas J. Obringer, Vandalia, all of Ohio

[73] Assignee: NCR Corporation, Dayton, Ohio

[21] Appl. No.: 08/967,199

[22] Filed: Oct. 29, 1997

Related U.S. Application Data

[63] Continuation of application No. 08/662,734, Jun. 10, 1996, abandoned.

[51] Int. Cl.[6] ..... B41M 5/26

[52] U.S. Cl. ..... 428/447; 428/195; 428/341; 428/480; 428/484; 428/488.1; 428/522; 428/913; 428/917

[58] Field of Search ..... 428/195, 206, 428/207, 447, 484, 488.1, 341, 480, 522, 913, 914

[56] References Cited

U.S. PATENT DOCUMENTS

| | | |
|---|---|---|
| 3,663,278 | 5/1972 | Blose et al. . |
| 4,315,643 | 2/1982 | Tokunaga et al. . |
| 4,403,224 | 9/1983 | Wirnowski . |
| 4,463,034 | 7/1984 | Tokunaga et al. . |
| 4,628,000 | 12/1986 | Talvalkar et al. . |
| 4,687,701 | 8/1987 | Knirsch et al. . |
| 4,707,395 | 11/1987 | Ueyama et al. . |
| 4,777,079 | 10/1988 | Nagamoto et al. . |
| 4,778,729 | 10/1988 | Mizobuci . |
| 4,840,848 | 6/1989 | Koshizuka et al. . |
| 4,923,749 | 5/1990 | Talvalkar . |
| 4,975,332 | 12/1990 | Shini et al. . |
| 4,983,446 | 1/1991 | Taniguchi et al. . |
| 4,988,563 | 1/1991 | Wehr . |
| 5,128,308 | 7/1992 | Talvalkar . |
| 5,240,781 | 8/1993 | Obata et al. . |
| 5,248,652 | 9/1993 | Talvalkar . |
| 5,266,382 | 11/1993 | Tuyuguchi et al. ..... 428/484 |
| 5,348,348 | 9/1994 | Hanada et al. . |
| 5,612,134 | 3/1997 | Okita et al. . |

FOREIGN PATENT DOCUMENTS

| | | |
|---|---|---|
| 0429666 | 6/1991 | European Pat. Off. . |
| 0499195 | 8/1992 | European Pat. Off. . |

OTHER PUBLICATIONS

Patent Abstracts of Japan, vol. 010, No. 336(M–535), Nov. 14, 1986 & JP 61 139489 A (Ricoh Co. Ltd), Jun. 26, 1986.

*Primary Examiner*—Pamela R. Schwartz
*Attorney, Agent, or Firm*—Millen White Zelano & Branigan

[57] ABSTRACT

There is provided by the present invention a coating formulation and thermal transfer ribbons obtained therefrom which do not require the application of a separate backcoating to the substrate employed. A backcoating is self-generated on the untreated side of the substrate from the thermal transfer layer of the ribbon when the two contact. A thermal transfer ribbon with a self-generated backcoat is also provided.

9 Claims, 2 Drawing Sheets

BACKCOAT FOR THERMAL TRANSFER RIBBONS

This is a continuation of application Ser. No. 08/662,734, filed on Jun. 10, 1996, now abandoned.

FIELD OF THE INVENTION

The present invention relates to thermal transfer printing wherein images are formed on a receiving substrate by heating extremely precise areas of a print ribbon with thin film resistors. This heating of the localized area causes transfer of ink or other sensible material from the ribbon to the receiving substrate. Sensible material is typically a pigment or dye which can be detected optically or magnetically.

More particularly, the present invention is directed to coating formulations and thermal transfer media (ribbons) obtained therefrom having a protective backcoat on the substrate of the thermal transfer medium which is self-generating.

BACKGROUND OF THE INVENTION

Thermal transfer printing has displaced impact printing in many applications due to advances such as the relatively low noise levels which are attained during the printing operation. Thermal transfer printing is widely used in special applications such as in the printing of machine readable bar codes and magnetic alpha-numeric characters. The thermal transfer process provides great flexibility in generating images and allows for broad variations in style, size and color of the printed image. Representative documentation in the area of thermal printing includes the following patents:

U.S. Pat. No. 3,663,278, issued to J. H. Blose et al. on May 16, 1972, discloses a thermal transfer medium comprising a base with a coating comprising of cellulosic polymer, thermoplastic aminotriazine-sulfonamide-aldehyde resin, plasticizer and a "sensible" material such as a dye or pigment.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Winowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,463,034, issued to Y. Tokunaga et al. on Jul. 31, 1984, discloses a heat-sensitive magnetic transfer element having a hot melt or a solvent coating.

U.S. Pat. No. 4,628,000, issued to S. G. Talvalkar et al. on Dec. 9, 1986, discloses a coating formulation that includes an adhesive-plasticizer or sucrose benzoate transfer agent and a coloring material or pigment.

U.S. Pat. No. 4,687,701, issued to K. Knirsch et al. on Aug. 18, 1987, discloses a heat sensitive inked element using a blend of thermoplastic resins and waxes.

U.S. Pat. No. 4,707,395, issued to S. Ueyama et al., on Nov. 17, 1987, discloses a substrate, a heat-sensitive releasing layer, a coloring agent layer, and a heat-sensitive cohesive layer.

U.S. Pat. No. 4,777,079, issued to M. Nagamoto et al. on Oct. 11, 1988, discloses an image transfer type thermosensitive recording medium using thermosoftening resins and a coloring agent.

U.S. Pat. No. 4,778,729, issued to A. Mizobuchi on Oct. 18, 1988, discloses a heat transfer sheet comprising a hot melt ink layer on one surface of a film and a filling layer laminated on the ink layer.

U.S. Pat. No. 4,923,749, issued to Talvalkar on May 8, 1990, discloses a thermal transfer ribbon which comprises two layers, a thermosensitive layer and a protective layer, both of which are water based.

U.S. Pat. No. 4,975,332, issued to Shini et al. on Dec. 4, 1990, discloses a recording medium for transfer printing comprising a base film, an adhesiveness improving layer, an electrically resistant layer and a heat sensitive transfer ink layer.

U.S. Pat. No. 4,983,446, issued to Taniguchi et al. on Jan. 8, 1991, describes a thermal image transfer recording medium which comprises as a main component, a saturated linear polyester resin.

U.S. Pat. No. 4,988,563, issued to Wehr on Jan. 29, 1991, discloses a thermal transfer ribbon having a thermal sensitive coating and a protective coating. The protective coating is a wax-copolymer mixture which reduces ribbon offset.

U.S. Pat. Nos. 5,128,308 and 5,248,652, issued to Talvalkar, each disclose a thermal transfer ribbon having a reactive dye which generates color when exposed to heat from a thermal transfer printer.

U.S. Pat. No. 5,240,781, issued to Obatta et al., discloses an ink ribbon for thermal transfer printers having a thermal transfer layer comprising a wax-like substance as a main component and a thermoplastic adhesive layer having a film forming property.

Thermal transfer ribbons are a common form of thermal transfer media. Most thermal transfer ribbons employ polyethylene terephthalate (PET) polyester as a substrate. The functional layer which transfers ink, also referred to as the thermal transfer layer, is deposited on one side of the substrate and a protective backcoat is deposited on the other side of the polyethylene terephthalate substrate. Untreated polyethylene terephthalate will not pass under a thermal print head without problems. The side of the polyethylene terephthalate substrate which comes in contact with the print head, i.e., the side opposite the thermal transfer layer, must be protected during the printing process. Failure to do so will result in the polyethylene terephthalate sticking to the heating elements during the heating cycle. Polyethylene terephthalate is also an abrasive material which will cause unacceptable wear on the print head. Therefore, conventional thermal transfer ribbons which employ a polyethylene terephthalate substrate treat the backside of the substrate as part of the coating process to form a barrier between the polyethylene terephthalate and the print head. This material is referred to herein as a "backcoat".

Various methods are used to apply backcoats to polyethylene terephthalate films. The most common method is to apply the backcoat as part of the in-line manufacturing process. Another method is to backcoat the polyethylene terephthalate in a separate step during the production process. A third method is to apply the polyethylene terephthalate film prior to the production process. Polyethylene terephthalate films can be purchased with the backcoat already applied. It would be advantageous to produce thermal transfer ribbons with PET substrates without the need to actively apply the backcoat to the substrate to simplify production and reduce costs.

SUMMARY OF THE INVENTION

It is an object of the present invention to provide a coating formulation for thermal transfer ribbons with PET substrates which eliminates the need to apply a separate backcoat layer.

It is another object of the present invention to provide a thermal transfer ribbon having a PET substrate which does not require the application of a separate backcoat.

It is an additional object of the present invention to provide a thermal transfer ribbon which self-generates a backcoat.

These and other objects and advantages of the present invention will become apparent and further understood from the detailed description and claims which follow, together with the annexed drawings.

The above objects are achieved through the use of a coating formulation and/or thermal transfer ribbon of the present invention. The coating formulation of the present invention comprises a silicone resin of a molecular weight and viscosity suitable for use as a backcoat in addition to the conventional components of wax, binder resin, pigment and solvent. The thermal transfer ribbon of the present invention comprises a flexible polyethylene terephthalate substrate and a functional layer which comprises wax, binder resin, pigment, sometimes residual solvent and silicone resin of a molecular weight and viscosity suitable for use as a backcoat. This thermal transfer ribbon will self-generate a backcoat on the PET film when the functional layer is exposed to the untreated surface of the PET substrate. A preferred embodiment of this invention is a thermal transfer ribbon as described above, wherein the functional layer has contacted the untreated surface of the polyethylene terephthalate substrate for a period of at least 24 hours so as to self-generate a backcoating. The silicone resin within the functional layer migrates to the untreated surface of the PET substrate forming a backcoat. Such contact can be provided by rolling or layering the thermal transfer ribbon.

BRIEF DESCRIPTION OF THE DRAWINGS

FIG. 4*a* represents the thermal transfer medium immediately after production. FIG. 4*b* represents the thermal transfer medium 24 hours or more after production.

DETAILED DESCRIPTION OF THE PREFERRED EMBODIMENTS

Figure 1:
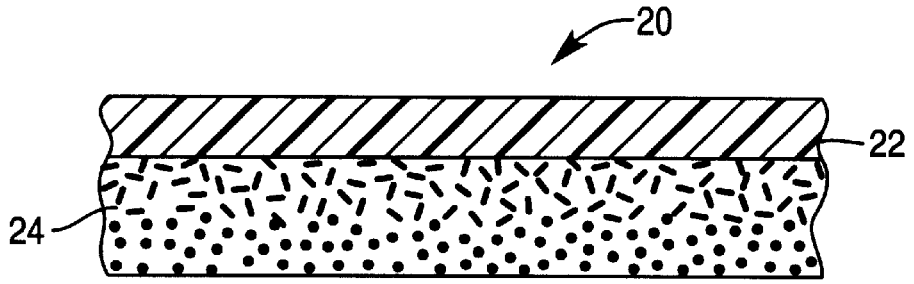
FIG. 1 illustrates a thermal transfer ribbon of the present invention, wherein the functional layer has not contacted the untreated surface of the substrate.

Thermal transfer ribbon 20 as illustrated in FIG. 1 is a preferred embodiment of this invention and preferably comprises substrate 22 of polyethylene terephthalate and a functional layer 24, also referred to as a thermal transfer layer herein. The thickness of the polyethylene terephthalate substrate can vary widely and is preferably from 3 to 50 microns. Films of about 4.5 micron thickness are most preferred. While the coating formulations and ribbons of the present invention work well with polyethylene terephthalate substrates, they are not limited to the use of such substrates. Materials such as polyethylene naphthalate films, polyamide films, e.g., nylon, polyolefin films, e.g., polypropylene film, cellulose films, e.g., triacetate film and polycarbonate films can also be used. The substrate should have high tensile strength to provide ease in handling and coating, and preferably provide these properties at a minimum thickness and low heat resistance to prolong the life of the heating elements within thermal print heads.

Figure 2:
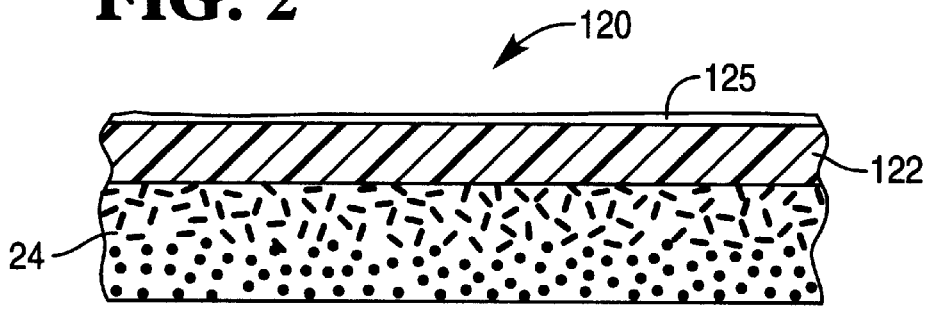
FIG. 2 is a thermal transfer ribbon of the present invention, wherein the functional layer has contacted the untreated surface of the substrate and a backcoating has formed.

FIG. 2 illustrates a thermal transfer medium 120 of the present invention in which the untreated surface of substrate 122 has contacted the functional layer for at least 24 hours of another ribbon or another portion of the same ribbon. Backcoating 125 has formed on the untreated surface of substrate 122 from this contact.

Figure 3:
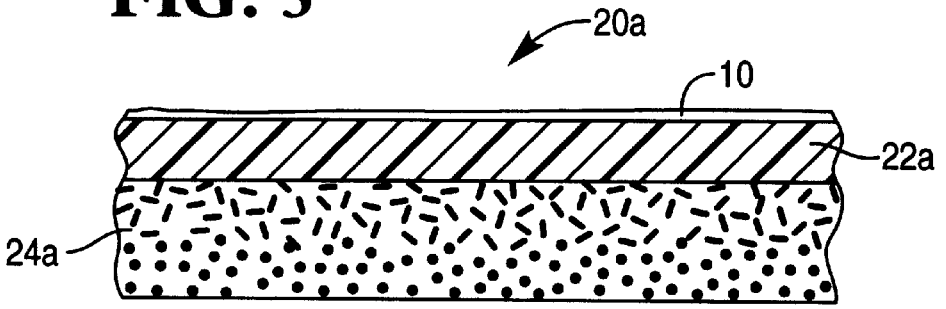
FIG. 3 illustrates a thermal transfer ribbon of the prior art.

FIG. 3 illustrates a thermal transfer medium 20*a* of the prior art having substrate 22*a*, thermal transfer layer 24*a* and backcoating 10. The thermal transfer ribbon 20 of FIG. 1 does not have a backcoating. The functional layer has not contacted the untreated surface of the substrate in this embodiment for a period long enough for the backcoating to form. The configuration in FIG. 1 is consistent with most thermal transfer ribbons of this invention immediately after deposition of the functional layer. A backcoating is formed by exposure of the untreated surface of the polyethylene terephthalate substrate to the thermal transfer layer.

Figure 4A:
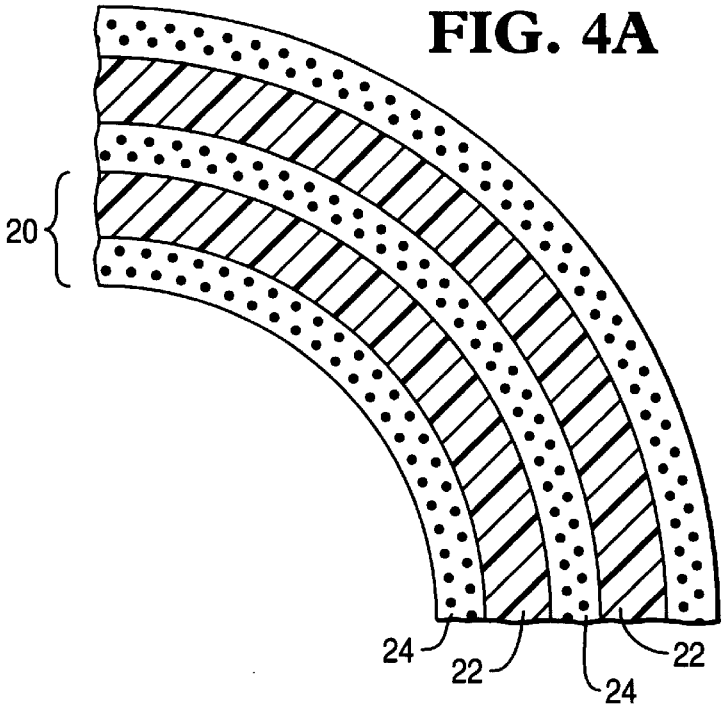
FIGS. 4*a* and 4*b* are representations of a portion of a thermal transfer ribbon of the present invention which is rolled to provide contact between the untreated surface of the substrate and the functional layer.
Figure 4B:
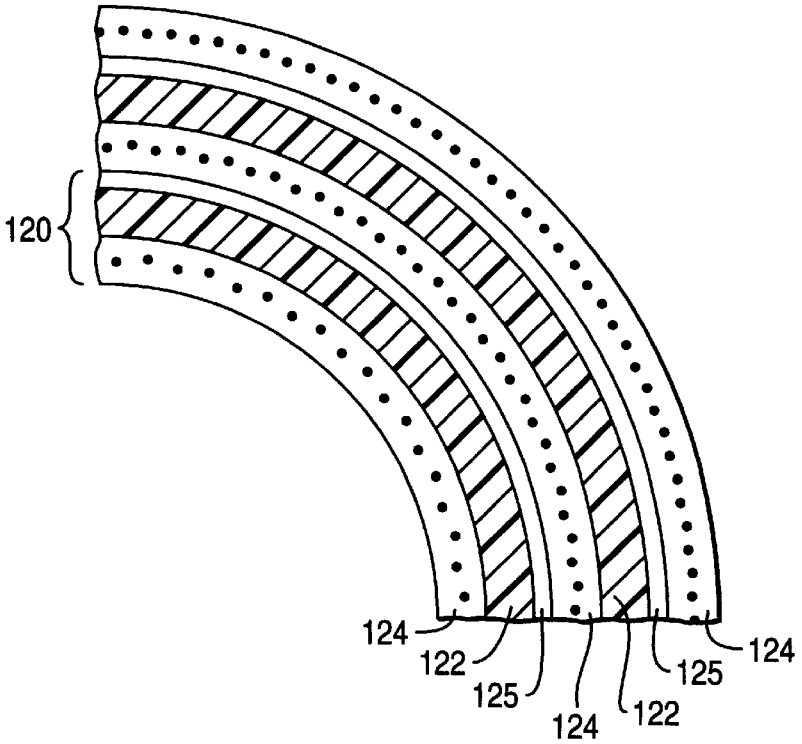

FIGS. 4*a* and 4*b* show a thermal transfer ribbons 20 and 120, respectively, in a rolled configuration which provides contact between the untreated surfaces of substrate 22 and functional layer 24 and the untreated surface of substrate 122 and functional layer 124. Thermal transfer ribbon 20 of FIG. 4*a* contains no backcoat since it was just produced. Thermal transfer ribbon 120 of FIG. 4*b* contains backcoat 125 formed since its production.

The coating formulation of this invention comprises the components of conventional coating formulations such as one or more waxes, binder resins, solvents and sensible materials (pigments). The coating formulations of the present invention additionally contain silicone resin backcoating material in an amount sufficient to migrate to the surface of the functional layer/thermal transfer layer.

Silicone resin backcoating materials which are preferred include high molecular weight polydimethylsiloxanes such as those available from General Electric Company and Dow Corning Corporation. Suitable examples include those polydimethylsiloxanes under the trade names "SE30" and "VISC-100M" provided by General Electric Company and Silastic 4-2901 and Silastic 4-2903 provided by Dow Corning Corporation. The silicone resin backcoating material is preferably added to the formulation at elevated temperatures following incorporation of the primary components (solvent, wax, binder resin and pigment). Alternative methods for preparing the coating formulation are suitable. The silicone resin backcoating formulation is employed in an amount sufficient to migrate to the surface of the functional layer without significantly interfering with its performance. The silicone resin is preferably employed in an amount in the range of about 0.005 to 10 weight percent based on the weight of dry components. More preferably the amount employed ranges from 0.02 to 10 weight percent and most preferably about 2 weight percent based on dry components.

The coating formulation of the present invention can be prepared in conventional equipment. The preferred method is to mix the solvent, wax components and binder resin at an elevated temperature, preferably about 190° F. When thoroughly mixed, the sensible pigment is added and the resulting mixture is ground in an attritor at an elevated temperature, preferably from about 140° F. to 160° F. Once complete, the silicone resin is added and the mixture mixed at an elevated temperature, preferably about 190° F. to obtain an uniform mixture suitable for coating onto a substrate.

The coating formulation comprises wax as a main dry component. Suitable waxes provide temperature sensitivity and flexibility. Examples include natural waxes such as carnauba wax, rice bran wax, bees wax, lanolin, candelilla wax, motan wax and ceresine wax; petroleum waxes such as paraffin wax and microcrystalline waxes; synthetic hydrocarbon waxes such as low molecular weight polyethylene and Fisher-Tropsch wax; higher fatty acids such as lauric acid, myristic acid, palmitic acid, stearic acid and behenic acid; higher aliphatic alcohol such as stearyl alcohol and esters such as sucrose fatty acid esters, sorbitane fatty acid esters and amides. The wax-like substances have a melting point less than 200° C. and preferably from 40° C. to 130° C. The amount of wax in the coating formulation is preferably above 25 weight percent and most preferably ranges from 25 to 85 percent by weight, based on the weight of dry ingredients.

The coating formulation of this invention also comprises a binder resin. Suitable binder resins are those conventionally used in coating formulations. These include thermoplastic resins and reactive resins such as epoxy resins.

Suitable thermoplastic binder resins include those described in U.S. Pat. Nos. 5,240,781 and U.S. Pat. No. 5,348,348 which have a melting point of less than 300° C., preferably from 100° C. to 225° C. Examples of suitable thermoplastic resins include polyvinyl chloride, polyvinyl acetate, vinyl chloride-vinyl acetate copolymers, polyethylene, polypropylene, polyacetal, ethylene-vinyl acetate copolymers, ethylene alkyl (meth)acrylate copolymers, ethylene-ethyl acetate copolymers, polystyrene, styrene copolymers, polyamide, ethylcellulose, epoxy resin, xylene resin, ketone resin, petroleum resin, terpene resin, polyurethane resin, polyvinyl butyryl, styrene-butadiene rubber, saturated polyesters, styrene-alkyl (meth) acrylate copolymer, ethylene alkyl (meth)acrylate copolymers. Suitable saturated polyesters are further described in U.S. Pat. No. 4,983,446. Thermoplastic resins are preferably used in an amount of from 2 to 35 weight percent based on the total dry ingredients of the coating formulation.

Suitable reactive binder components include epoxy resins and a polymerization initiator (crosslinker). Suitable epoxy resins include those that have at least two oxirane groups such as epoxy novolak resins obtained by reacting epichlorohydrin with phenol/formaldehyde condensates or cresol/formaldehyde condensates. Another preferred epoxy resin is polyglycidyl ether polymers obtained by reaction of epichlorohydrin with a polyhydroxy monomer such as 1,4 butanediol. A specific example of suitable epoxy novolak resin is Epon 164 available from Shell Chemical Company. A specific example of the polyglycidyl ether is available from Ciba-Geigy Corporation under the trade name Araldite® GT 7013. The epoxy resins are preferably employed with a crosslinker which activates upon exposure to the heat from a thermal print head. Preferred crosslinkers include polyamines with at least two primary or secondary amine groups. Examples being Epi-cure P101 and Ancamine 2014FG available from Shell Chemical Company and Air Products, respectively. Accelerators such as triglycidylisocyanurate can be used with the crosslinker to accelerate the reaction. When used, the epoxy resins typically comprise more than 25 weight percent of the coating formulation based on dry components in view of their low viscosity. Waxes are typically not necessary when reactive epoxy resins form the binder.

The solvents employed in coating formulations of this invention can vary widely and are dependent on the solubility of the binder resin. Silicone resins, particularly when used in small amounts, can be dispersed in organic solvents. A preferred solvent is mineral spirits. Other suitable solvents include esters, ketones, ethers, alcohols, aliphatics and aromatics. The solids content of the coating formulation is typically within the range of 15 to 100 weight percent (hot melt), depending on the viscosity of the dry components therein.

The coating formulation also contains a sensible material or pigment which is capable of being sensed visually, by optical means, by magnetic means, by electroconductive means or by photoelectric means. The sensible material is typically a coloring agent, such as a dye or pigment, or magnetic particles. Any coloring agent used in conventional ink ribbons is suitable, including carbon black and a variety of organic and inorganic coloring pigments and dyes, examples of which include phthalocyanine dyes, fluorescent naphthalimide dyes and others such as cadmium, primrose, chrome yellow, ultra marine blue, titanium dioxide, zinc oxide, iron oxide, cobalt oxide, nickel oxide, etc. Examples of sensible materials include those described in U.S. Pat. No. 3,663,278 and U.S. Pat. No. 4,923,749. Reactive dyes such as leuco dyes are also suitable. In the case of magnetic thermal printing, the thermal transfer layer includes a magnetic pigment or particles for use in imaging to enable optical human or machine reading of the characters. This provides the advantage of encoding or imaging the substrate with a magnetic signal inducible ink. The sensible material or pigment is typically used in an amount of from 1 to 50 parts by weight to the total dry ingredients of the coating formulation.

The coating formulations may contain conventional additives such as plasticizers, viscosity modifiers, tackifiers, etc.

A preferred formulation is that containing a mixture of waxes include paraffin wax, carnauba wax and hydrocarbon wax in an amount ranging from 60 to 75 weight percent based on the total dry ingredients. With this mixture of waxes, an ethyl vinyl acetate copolymer binder resin is preferably employed with a carbon black pigment. Mineral spirits are preferred as the solvent and the silicone resin is preferably one or more of SE30 polydimethylsiloxane, VISC-100 polydimethylsiloxane, Silastic 4-2400 polydimethylsiloxane or Silastic 4-2903 polydimethlysiloxane described above. This preferred formulation is made by mixing the solution of mineral spirits, hydrocarbon wax, paraffin wax, carnauba wax and ethyl vinyl acetate copolymer binder resin for about 15 minutes at a temperature of about 190° F. After which carbon black and black ink are added and ground in an attritor at about 140° F. to 160° F. for about two hours. The silicone resin is then added at a temperature of 190° F., wherein mixing is continued for about 15 minutes.

The thermal transfer ribbon of the present invention comprises a substrate as described above, preferably polyethylene terephthalate, and a functional layer comprised of wax, pigment, binder resin, sometimes residual solvent and a high molecular weight silicone resin suitable for use as a backcoating. The functional layer is preferably obtained from the coating formulation of the present invention. Suitable waxes, binder resins, pigments and silicone resins are as described above. The thermal transfer layer (functional layer) preferably has a softening point within the range of about 50° C. to 250° C. which enables transfer at normal print head energies which range from about 100° C. to 250° C. and more typically from about 100° C. to 150° C. The thermal transfer ribbon of the present invention can be prepared from formulations of the present invention in the form of either a solution, dispersion or emulsion. Once applied to the substrate, a portion of the solvent can remain in the coating. The ribbons can be prepared by conventional techniques and equipment such as a Meyer Rod or like wire round doctor bar set up on a conventional coating machine to provide the coating weights described above. The coating weight of the thermal transfer layer typically ranges from 1.9 to 4.3 g/m$^2$. A temperature of about 160° F. is maintained during the entire coating process. After the coating formulation is applied, it is optionally passed through a dryer at an elevated temperature to ensure drying and adherence of the functional layer to the substrate. The thermal transfer layer can be fully transferred onto a receiving substrate such as paper or synthetic resin at a temperature in the range of 75° C. to 200° C.

The thermal transfer ribbon of the present invention provides the advantages of thermal printing. When the thermal transfer ribbon is exposed to the heating elements of the thermal print head, the thermal transfer layer softens and transfers from the ribbon to the receiving substrate with some of the silicone resin backcoating therein.

To obtain effective use of the thermal transfer medium of the present invention, the functional layer must contact the untreated surface of the substrate, preferably by rolling the layer onto itself as in FIGS. 4*a* and 4*b*. By rolling the thermal transfer medium in this fashion, the backcoating material migrates to the back of the polyethylene terephthalate substrate forming a backcoat. Alternative configurations for achieving this backcoat are suitable such as layering multiple of sheets of the thermal transfer medium.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosure of all applications, patents and publications, cited above and below, are hereby incorporated by reference.

EXAMPLES

Example 1 - Coating Formulation

A coating formulation of the present invention is prepared by mixing mineral spirits, wax and binder resin in the proportions indicated in Table 1 and heating the mixture to 190° F. for 15 minutes. Carbon black and black ink in the proportions indicated in Table 1 are added to the resultant mixture and ground in an attritor at a temperature of from about 140° F. to 160° F. for about 2 hours. Following grinding, a silicone resin in the amount indicated in Table 1 is added and the mixture is mixed at 190° F. for 15 minutes.

TABLE 1

| Material | Weight Percent Dry | Weight Percent Dry - Range | Grams Dry | Grams Wet |
|---|---|---|---|---|
| Modified Hydrocarbon Wax[1] | 23.5 | 15–30% | 28.2 | 28.2 |
| Fully Refined Paraffin Wax[2] | 37.2 | 20–45% | 44.6 | 44.6 |
| Carnauba Wax[3] | 10.2 | 5–40% | 12.2 | 12.2 |
| Ethyl Vinyl Acetate Copolymer Resin[4] | 5.6 | 2–10% | 6.7 | 6.7 |
| Carbon Black[5] | 17.5 | 1–20% | 21.1 | 21.1 |
| Silicone Resin[6] | 2.0 | 0.005–10% | 2.4 | 2.4 |
| Black Ink[7] | 4.0 | 0–10% | 4.8 | 4.8 |
| Mineral Spirits | — | — | — | 480 |
| Total | 100.0 | | 120.0 | 600 |

[1]Modified Hydrocarbon Wax = "WB-17" Modified Hydrocarbon Wax by Petrolite Corporation.
[2]Fully Refined Paraffin Wax = "Paraffin 1014" by Boler Petroleum Company.
[3]Carnauba Wax = "Carnauba NC #3 Wax" by R. A. Baldini & Co.
[4]Ethyl Vinyl Acetate Copolymer Resin = "Elvax 40W Ethyl Vinyl Acetate Copolymer Resin" by Chemcentral.
[5]Carbon Black = by Columbia Chemical.
[6]Silicone Resin = "SE30" or "VISC-100M" Polydimethylsiloxane by GE or "Silastic 4-2901 or 4-2903" Dimethylsiloxane from Dow Corning Corporation.
[7]Black Ink = "Neptune X-14" by BASF Corp.

Thermal Transfer Medium

A thermal transfer medium of the present invention is prepared by coating a formulation as defined above onto a 4.5 $\mu$m Polyester Mylar Film by E. I. Dupont de Nemours & Co., Incorporated at a coat weight of from 1.9 to 4.3 g/m$^2$. The solution is coated onto the mylar film at 160° F. using a doctor bar and subsequently dried. The thermal transfer medium formed is rolled onto a mandrel and stored for a period of at least 24 hours to permit migration of the silicone resin to the untreated surface of the polyethylene terephthalate substrate.

The preceding examples can be repeated with similar success by substituting the generically or specifically described reactants and/or operating conditions of this invention for those used in the preceding example.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A ribbon comprising a flexible substrate with an untreated surface and a thermal transfer layer positioned on the other surface having a softening point in the range of 50° C. to 250° C., said thermal transfer layer comprising wax, binder resin, sensible material, optionally residual solvent and a polydimethylsiloxane gum in an amount of 0.02 to 10 weight percent based on total dry ingredients uniformly mixed therein, wherein the polydimethylsiloxane gum has a molecular weight and viscosity suitable for forming a backcoat for the thermal transfer ribbon.

2. A ribbon as in claim 1, wherein the flexible substrate comprises polyethylene terephthalate, wherein the wax has a melting point in the range of 40° C. to 130° C.; and the binder resin is a thermoplastic polymer resin having a melting point in the range of 100° C. to 250° C. and comprises 2 to 35 weight percent of the dry components.

3. A ribbon as in claim 2, wherein more than one wax is employed in the thermal transfer layer and the binder resin is ethylene vinyl acetate copolymer.

4. A ribbon as in claim 1, wherein the thermal transfer layer has a coat weight within the range of 1.9–4.3 g/m$^2$.

5. A thermal transfer ribbon as in claim 1 which is rolled so as to contact the thermal transfer layer with the untreated surface of the flexible substrate which comprises a polyethylene terephthalate substrate.

6. A thermal transfer ribbon which comprises a flexible substrate, a thermal transfer layer coated on a surface of said flexible substrate, said thermal transfer layer having a softening point in the range of 50° C. to 250° C. and comprising wax, binder resin, sensible material, and a polydimethylsiloxane gum in an amount of 0.02 to 10 weight percent based on total dry ingredients uniformly mixed therein, and a backcoating of said polydimethylsiloxane gum on the opposite surface of said flexible substrate, which has migrated from a thermal transfer layer by contacting the opposite surface of said flexible substrate.

7. A thermal transfer ribbon as in claim 6, wherein the flexible substrate comprises polyethylene terephthalate, wherein the wax has a melting point in the range of 40° C. to 130° C.; and the binder resin is a thermoplastic polymer resin having a melting point in the range of 100° C. to 250° C. and comprises 2 to 35 weight percent of the dry components.

8. A thermal transfer ribbon as in claim 6, wherein the thermal transfer layer has a coat weight within the range of 1.9–4.3 g/m$^2$.

9. A thermal transfer ribbon as in claim 6, wherein more than one wax is employed in the thermal transfer layer and the binder resin is ethylene vinyl acetate copolymer.

* * * * *